United States Patent [19]

Jones

[11] Patent Number: 4,531,580

[45] Date of Patent: Jul. 30, 1985

[54] ROTATING BLOWOUT PREVENTERS

[75] Inventor: Marvin R. Jones, Houston, Tex.

[73] Assignee: Cameron Iron Works, Inc., Houston, Tex.

[21] Appl. No.: 511,752

[22] Filed: Jul. 7, 1983

[51] Int. Cl.[3] ..... E21B 33/06

[52] U.S. Cl. ..... 166/84; 166/95; 251/1.1; 277/31

[58] Field of Search ..... 166/82, 83, 84, 95; 251/1 R; 277/31, 235 R, 5

[56] References Cited

U.S. PATENT DOCUMENTS

| | | | |
|---|---|---|---|
| 4,098,516 | 7/1978 | Murman | 277/235 R |
| 4,143,880 | 3/1979 | Bunting et al. | 277/31 |
| 4,208,056 | 6/1980 | Biffle | 277/31 |
| 4,312,404 | 1/1982 | Morrow | 166/84 |
| 4,367,795 | 1/1983 | Biffle | 166/84 |
| 4,423,776 | 1/1984 | Wagoner et al. | 166/84 |
| 4,441,551 | 4/1984 | Biffle | 166/84 |
| 4,448,255 | 5/1984 | Shaffer et al. | 166/84 |

*Primary Examiner*—Stephen J. Novosad
*Assistant Examiner*—William P. Neuder
*Attorney, Agent, or Firm*—Vinson & Elkins

[57] ABSTRACT

An improved rotating blowout preventer having a sealing assembly which is latched in place in a body with an upper latch engaging the non rotating body and lower latch engaging in a groove to engage the rotating portion, a sealing assembly having an improved elongate flexible tubular sealing element for sealing against a rotating Kelly or other element and being sufficient long and resilient to seal under conditions of lateral misalignment without interfering with the rotation and an improved support system which maintains a predetermined bearing load and transfers excess loads to the body.

32 Claims, 14 Drawing Figures

K
75
69
68
67a
71
71a
37c
26a
26b
37d
47
40
37e
39
48
41
35
76
34
33
26
31
66
60
72
74
50
58
61
62
65
42
46
44
45
27
37c
26a
43
26b
47
49
40
39
37
48
41
36
33
32
26
30
29
28
55
37b
54
38
51
36a
52

46
42
27
44
59
138
138b
45
26a
43
50
53
55
54
57
38a
38c
38b
50
38d
56
58
51
52
26
26b
26c
47
48
40
38
39
37
36a
41
36
33
26
32

42
27
43
39
33
26
31
37b
38c
38a
38b
38d
36a
51
53
54
50
52
66
46
42
44
27
45
37c
26a
43
26b
26c
47
49
40
38
37
39
41
33
32
26
29
3A
3A

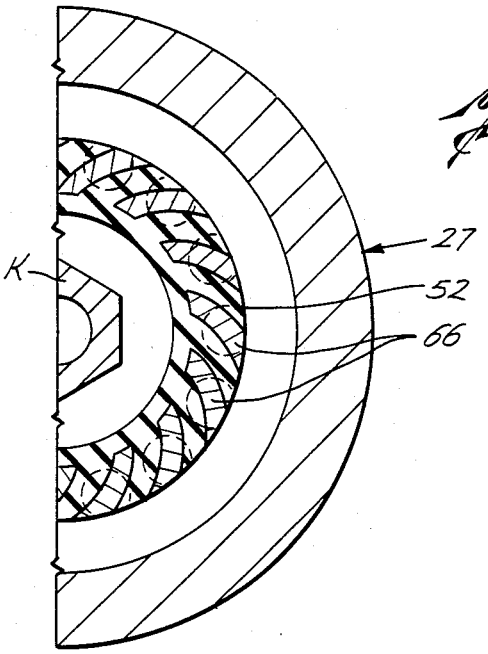
Fig. 3A
Fig. 5
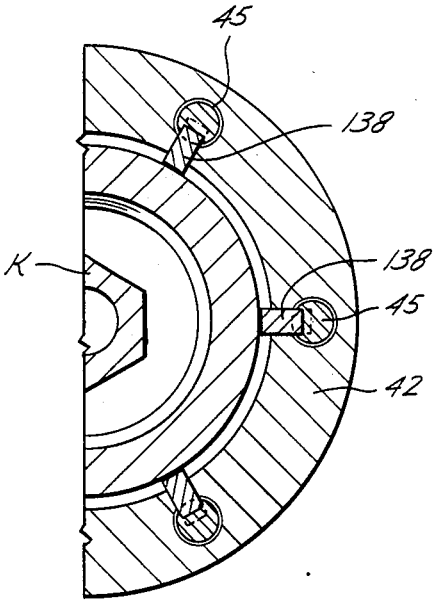
Fig. 6
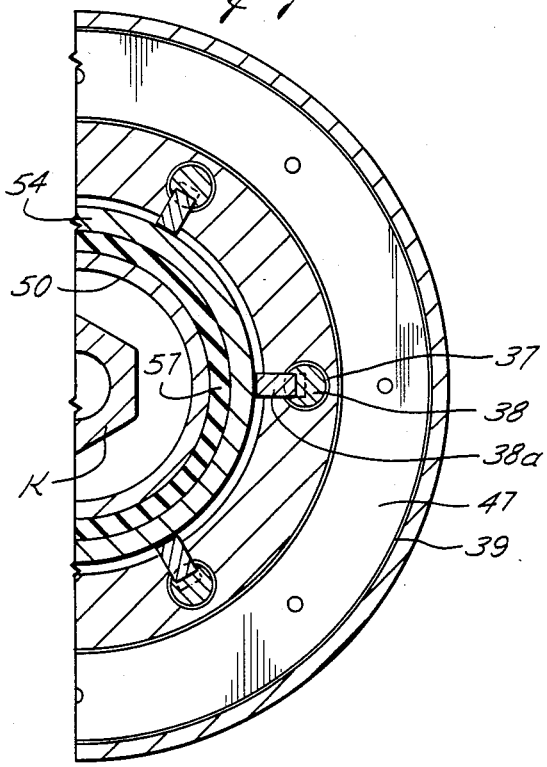
Fig. 5A
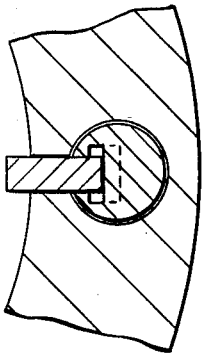

K
70
69
42
46
44
27
5
5
45
43
43
50
55
54
56
57
38a
56a
38b
58
51
26b
26c
47
49
40
39
37
36a
41
36
33
6
6
39
33
52
26
26
29

67a
59
53
55
54
50
57
56
58
56a
58
51
45
138
37c
37c
37d
37e
38b
38a
38d
52
38
47
48
40
41

ROTATING BLOWOUT PREVENTERS

BACKGROUND OF THE INVENTION

Rotating well blowout preventers are constructed to seal about the rotating Kelly joint or the drill pipe during a well drilling operation to prevent blow outs caused by the escape of well fluids under high pressures.

Drillers employ rotating heads primarily for drilling with mud whose density cannot supply sufficient hydrostatic head to balance the pressure of fluids contained in pores of exposed formations. In such operations, both gas and liquids flow continuously into the well bore. The rotating head enables the driller to impose back pressure at the head so as to control the bottom hole pressure and, in consequence, the rate of inflow. It also permits him to trip the pipe under pressure. Low density mud costs less to buy and less to pump. Low bottom hole pressure increases bit life and penetration rate.

There are many prior rotating blowout preventers in the art but for various reasons, such prior devices have not performed totally satisfactorily. Among the reasons for their poor performance is the inability to contain the higher pressures encountered during the drilling operation. This failure to resist the higher pressures is caused by reason of the drive bushing and the sealing element which engage the Kelly joint not being properly arranged to fully accommodate the usual lateral movement of the Kelly occurring between the rotary table and the blowout preventer stack. This results in excessive loads and wear being imposed not only upon the sealing element but also upon the Kelly joint. Further, the prior art has not recognized the importance of the shape and specific construction and reinforcement of the sealing element to maintain a proper seal about the rotating Kelly joint or pipe.

Another reason for inadequate performance has been an excessive wear upon or early failure of the bearings which support the rotating parts. This is the result of inadequate or improper location and mounting of the bearings relative to the position of the sealing element and the rotating housing of the unit. And lastly, although the prior art suggests that the sealing assembly should be capable of being latched and unlatched from the remainder of the structure by remotely controlled means, no satisfactory or efficient way of performing such latching and unlatching has been developed.

THE PRIOR ART

The general combination of a supporting body and a sealing element or stripper rubber is disclosed in several prior patents, such as U.S. Pat. Nos. 3,083,973 and 3,934,887. However, the structure of the sealing elements does not effectively seal and the bearing arrangements fail to provide satisfactory mountings for the bearings of this type of equipment.

U.S. Pat. No. 3,965,987 features concentric double stripper elements with one of its objectives being to handle pipes of different diameters. These stripper elements are inadequate under the heavy duty service to which rotating blowout preventers are subjected.

U.S. Pat. Nos. 4,154,448 and 4,208,056 illustrate a sealing or stripper rubber having pivoted reinforcing members embedded within the stripper rubbers. Such reinforcing elements as well as the stripper rubbers do not encircle the pipe and do not form an effective seal, particularly under high pressure.

Applicant's prior U.S. Pat. No. 4,009,904 discloses the use of metal inserts disposed in somewhat of a circumferential path within the resilient portion of the sealing element but requires mechanical actuation to form its seal while well pressure alone actuates the sealing element of the present invention to form an effective, long lasting seal about a rotating element. U.S. Pat. No. 2,746,781, another of applicant's prior patents relates to a combination stripper and wiper rubber for sealing about a pipe but was not mounted for rotation with a rotating member; also the body of the rubber is relatively short with a thick wall so that it lacks the flexibility to effectively seal about a member which is non-circular in cross section without excessive wear.

Prior patents illustrating somewhat similar bearing mountings are U.S. Pat. Nos. 2,303,040 and 3,052,300. However, the position and load carrying capacity is ineffective for mounting the rotating elements of a blowout preventer.

Remote control of latching members in blowout preventers is shown in U.S. Pat. Nos. 3,614,111 and 3,671,912. The mechanism and arrangement of these prior remote control systems do not perform satisfactorily for their intended purpose and are not fool-proof in operation.

Rotating blowout preventers are presently on the market. One such preventer manufactured by NL Shaffer Co. of Los Angeles, Calif., is their type 50 which appears on page 4914 of the 1978–79 Composite Catalog of Oil Field Equipment. Another preventer of this type is manufactured by Grant Oil Tool Company, also located in Los Angeles, Calif. Both of these devices are of a different construction and do not have the important features of the invention described herein. The Grant preventer appears on page 2077 of the 1964–65 edition of the Composite Catalog.

Other prior patents in the general field of rotating blowout preventers and which are hereby made of record are U.S. Pat. Nos. 2,904,357, 3,128,614, 3,387,851, 3,400,938 and 4,157,186. These patents disclose various sizes, shapes and wall thicknesses of sealing elements and represent the general state of this art.

SUMMARY

This invention relates to new and useful improvements in rotating blowout preventers.

The invention provides a rotating blowout preventer having an improved elongate tubular sealing element to seal against the rotating Kelly joint or pipe extending therethrough, a mounting for the sealing element which accommodates lateral misalignments of the joint or pipe, a bearing assembly subjected only to a predetermined bearing load with the bearings protected from excess loads and a remote control latch to retain the sealing element in its sealing position.

One object of this invention is to provide a rotating blowout preventer having an improved sealing element which engages the exterior of a Kelly joint or a pipe to effectively seal the annulus area around said Kelly joint or pipe as each is rotated during a drilling operation.

Another object is to provide an improved sealing or packing element which is relatively elongate and which is constructed to maintain its sealing engagement with a rotating Kelly joint or pipe throughout a substantial lateral or radial movement of said joint or pipe, whereby the annulus space between said joint or pipe and the well casing is effectively sealed against pressure leakage.

Another object is to reduce the load which the bearings must resist while rotating by providing a packing assembly which includes a reduced diameter for the rotating packing element of the assembly, a stationary portion of the assembly, and independent means for transmitting loads from the rotating packing element to the stationary portion of the blowout preventer body.

A further object is to reinforce the sealing element with metallic reinforcing members molded therein, with said members being capable of moving or swinging laterally as the sealing element is moved by reason of lateral displacement of the rotating Kelly joint or pipe with which said sealing element is engaged, whereby the element is properly reinforced by the members in all lateral positions as it follows or complies with any lateral position of the Kelly joint or pipe and therefore, is capable of sealing against high pressures during the rotative movement of said joint or pipe.

An important object is to provide an improved bearing assembly for rotatably mounting a housing with respect to the body of a blowout preventer, said housing having the sealing means which seals about the Kelly joint, pipe or other element secured therein whereby said sealing means may rotate with said joint or pipe; the bearing assembly being constructed to support or carry a predetermined normal pressure load to which the sealing means and rotatable housing are subjected but being so mounted that any excessive pressure load is transferred directly to the body of the blowout preventer to relieve the bearings of such excessive load and thereby result in less bearing wear and increased bearing life.

A further object is to provide a bearing assembly which interposes a spring means of predetermined strength between the bearings and the main body of the blowout preventer so that normal pressure loads applied to the bearing assembly are carried by the bearings and said spring means; the structure being so arranged that the application of an excessive pressure load exceeding the strength of the spring means collapses said means and transfers the excess load of the pressure load directly above a predetermined bearing load to the body of the blowout preventer to thereby relieve the bearings of said excessive pressure load.

Still another object is to combine a spring means in the form of a Belleville washer with the bearings to accomplish the transfer of the excess load directly to the blowout preventer body when such pressure load exceeds the spring strength of said washer.

An important object of the invention is to provide a rotating blowout preventer which seals about a Kelly joint or pipe wherein the sealing assembly is latched into place within the body of the preventer with an improved type of latching arrangement having a remotely controlled means for actuating said latching arrangement, so that the sealing assembly may be removed from the preventer without the necessity of exposing personnel to danger in having to descend below the well derrick floor to manually disconnect said assembly.

Still another object is to provide an improved remotely controlled latching means for latching the sealing assembly within the blowout preventer body wherein a double latch means forms a positive connection between the sealing assembly and body to assure that pressure, even though excessive, will not displace the sealing assembly; the control for said latching means also including a locking means which will not permit unlatching the sealing assembly before the well pressure has been released to assure that said sealing assembly may be safely removed from its position within the blowout preventer housing.

BRIEF DESCRIPTION OF THE DRAWINGS

FIG. 3A is a partial horizontal, cross-sectional view, taken on the line 3A—3A of FIG. 3 showing the reinforcing elements within the packing element.

FIG. 5 is a partial, horizontal cross-sectional view, taken on the line 5—5 of FIG. 4 and showing the upper latch members.

FIG. 6 is a partial horizontal, cross-sectional view, taken on the line 6—6 of FIG. 4, illustrating the lower latch members.

FIG. 6A is an enlarged sectional view of one of the lower latch members and illustrating the retaining flanges which are formed on each side of said member.

DESCRIPTION OF PREFERRED EMBODIMENT

Figure 1:
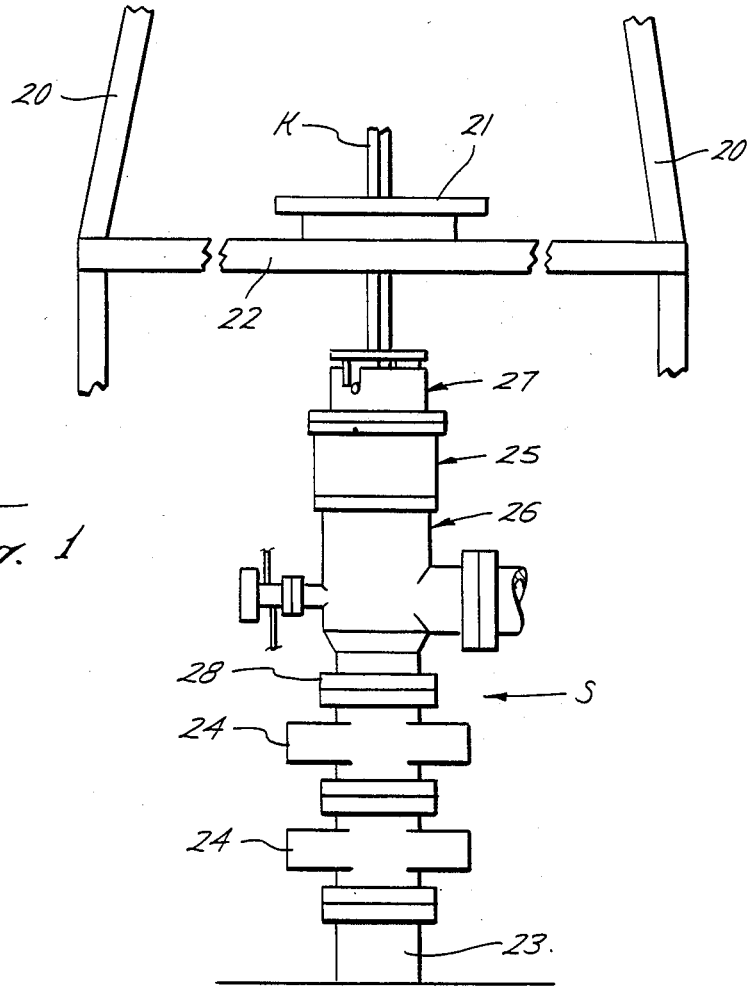
FIG. 1 is a schematic view of a blowout preventer stack which is located at the upper end of a well but below the derrick floor and illustrating a rotating blowout preventer, constructed in accordance with this invention, mounted as to the uppermost element of said stack.

In FIG. 1 of the drawings, the numeral 20 designates a portion of a usual derrick having a rotary table 21 mounted on the derrick floor 22. The rotary table is located in approximate vertical alignment with the usual surface casing 23 extending from the upper end of the well and a blowout preventer stack S is mounted on said casing. The blowout preventers 24 forming the stack S are schematically shown without the usual necessary conductors, flow lines and other connections.

The uppermost unit in the stack is the rotating blowout preventer 25 which constitutes the present invention. Extending downwardly through the rotary table 21 and blowout preventers 25 and 24 and then through the surface casing 23 is a Kelly joint K. As is well known the Kelly joint is multi-angular in cross section and is rotated by the rotary table to rotate a drill pipe (not shown) having a drill bit at its lower end. As the Kelly and drill pipe rotate, a well drilling operation is carried out. As is well known, during such drilling operation, the rotating Kelly joint and drill pipe undergo radial or lateral movements within the blowout preventer stack due to rig vibration or for other reasons.

The usual blowout preventers 24 are designed to completely close the annulus around the drill pipe or if the Kelly joint or pipe is not extending through the preventers, a preventer may completely close the bore. However, the usual preventer is not designed to close off around either a rotating pipe or a rotating Kelly joint and therefore, it cannot shut in the well pressure while the Kelly joint or pipe is being rotated during the drilling operation. The rotating blowout preventer 25 at the top of the stack is particularly constructed to perform the function of effectively closing the annular space surrounding the Kelly joint or pipe as the joint or pipe is rotating while drilling a well. By maintaining a seal around the joint or pipe K during the drilling operation, the danger of a blowout during such operation is eliminated.

Figure 2:
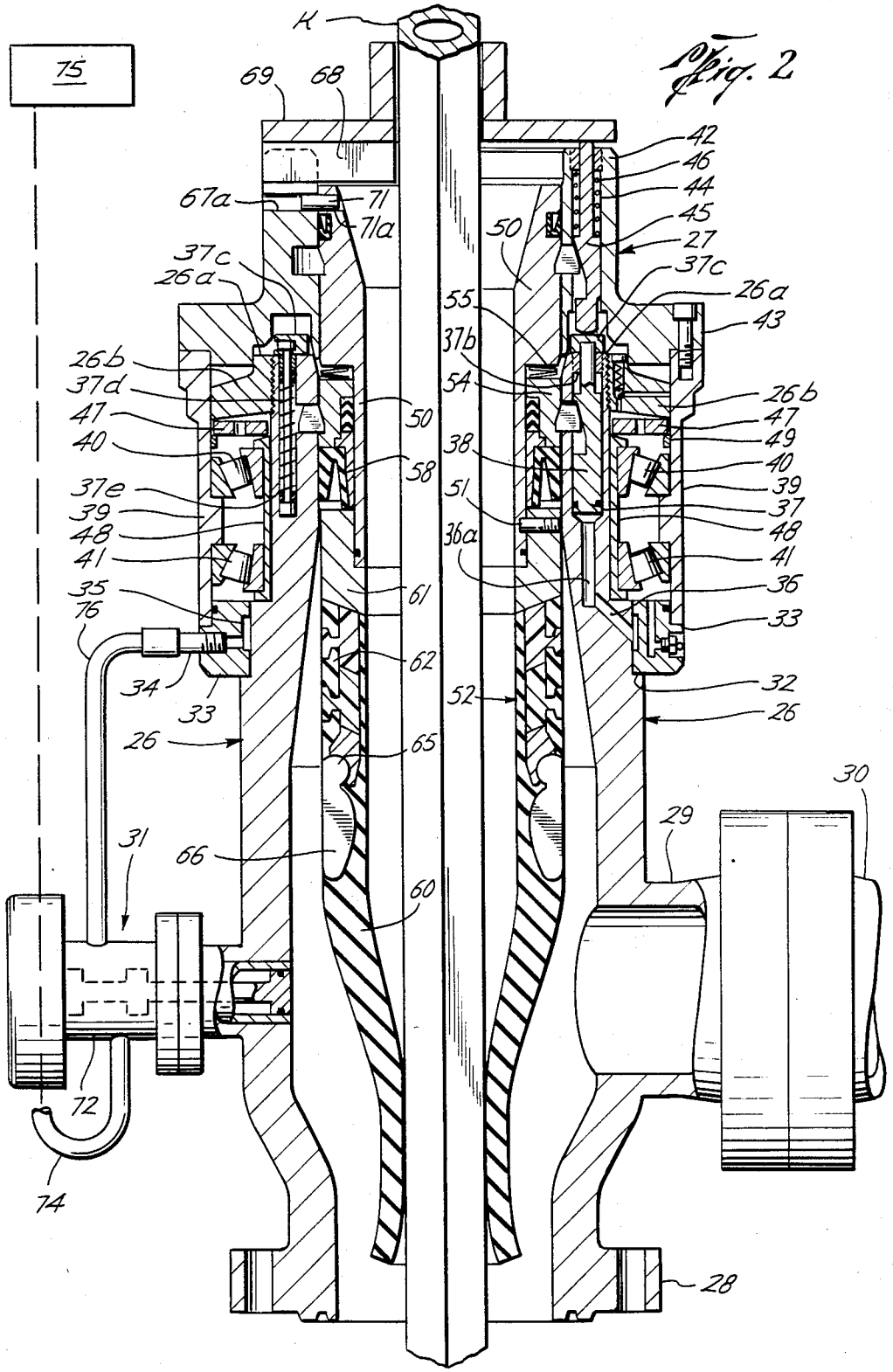
FIG. 2 is a transverse vertical sectional view of the rotating blowout preventer illustrating the sealing element in a position engaging the Kelly joint of a drill pipe but not deformed by high annulus pressure.
Figure 2A:
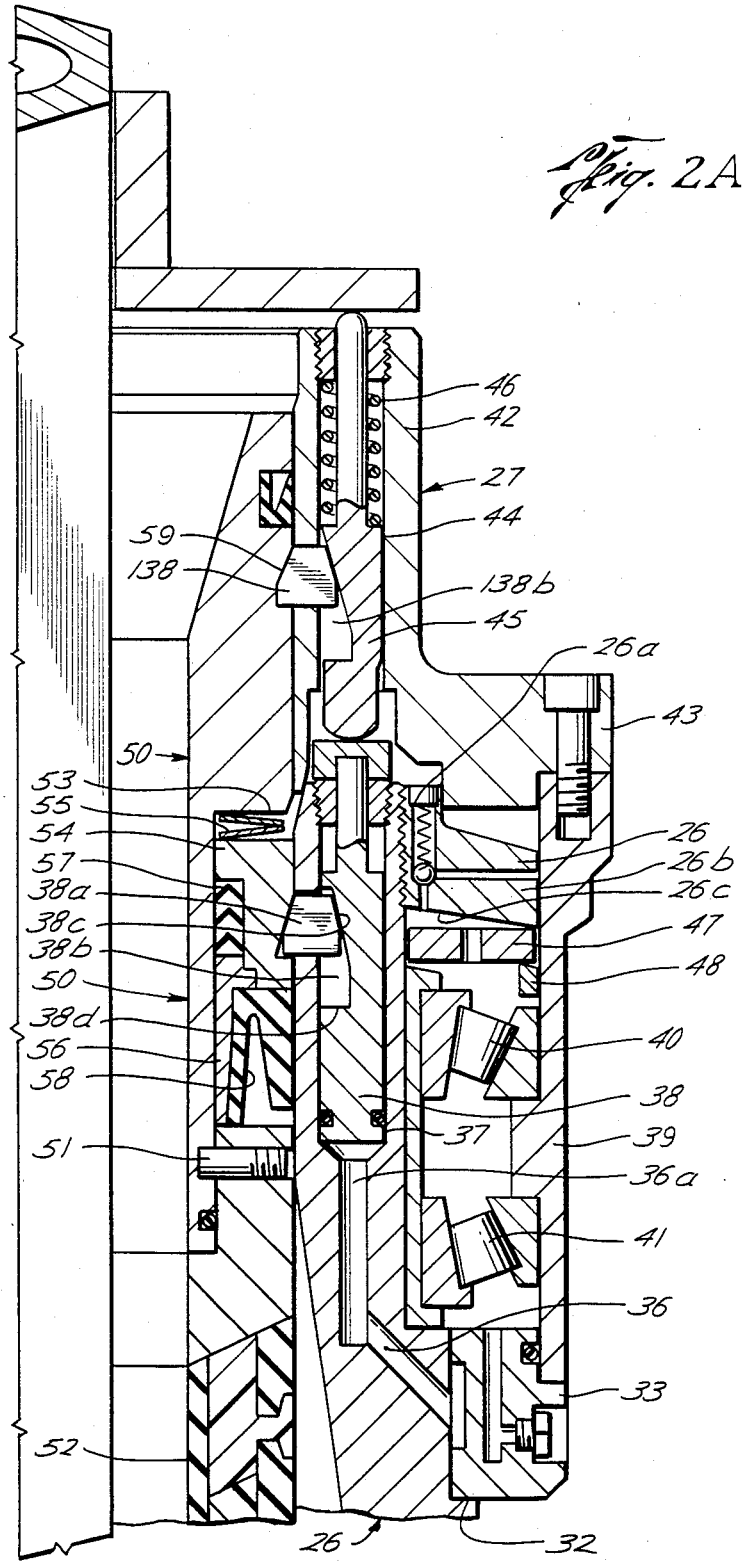
FIG. 2A is an enlarged partial sectional view showing the details of the latch control pistons and related parts.

Referring to FIG. 2, the rotating blowout preventer comprises a main body which includes a lower section 26 and an upper section 27. The lower section 26 has a flange 28 at its lower end for connection with the upper end of the uppermost blowout preventer 24 of the stack S. A side outlet 29 communicates with the well bore and extends from the lower portion of the body section 26 to connect with a suitable pipe or conductor 30. Opposite the outlet 29 and also communicating with the well bore is a pressure responsive unit 31, the purpose of which will be hereinafter explained. Spaced above the side outlet, an external annular shoulder 32 is formed to support a ring 33 which has a pressure line 34 connected therein. The inner wall of the ring has an internal annular groove 35 for conducting pressure to suitable passages 36 and **36*a* which communicate with a plurality of vertical piston bores 37 formed in the upper portion of the lower body section 26 (FIG. 2A). The vertical piston bores 37 are located in proximity to the inner wall of said body section and extend to the upper surface 26*a* of said section. A latch control piston 38 is movable within each bore and the upper ends of the pistons are connected to a ring member 37*c* which ring member is urged upwardly by a plurality of springs 37*d* disposed within vertical openings 37*e* formed in the lower body section 26 (FIG. 2A). Upward movement of each piston is limited by an annular stop shoulder 37*b* formed within each bore 37. The upper end portion of the body section 26 has an outwardly extending annular flange portion 26*b* which is spaced above the annular ring 33. The outer periphery of said flange 26*b* has the same diameter as the upper portion of the ring 33. As will be described later, the latch control pistons 38** function to latch an inner sealing assembly within the bore of the lower body section.

The upper section 27 of the main body has a cylindrical housing 39 bolted thereto and extending downwardly to encircle the upper portion of the lower body section 26. The housing engages the outer peripheries of both the flange **26*b* and ring 33 of said lower section. A pair of bearing assemblies 40 and 41 are located between the housing 39 and the lower body section 26 so that said housing may freely rotate about said section. The upper portion of the body section 27 comprises a cylindrical upwardly extending housing 42 of greater thickness than the housing 39 and having an outwardly extending flange 43. This housing and flange extend over the upper surface of the lower body section 26 and the flange is bolted to the cylindrical housing 39 whereby it will rotate with the latter on the bearings 40 and 41. Suitable shoulders and recesses are formed on the housing 42, flange 43 and housing 39 to engage with portions of the lower body section 26 to properly align the upper body section 27 during its rotation with respect to the lower body section 26. A plurality of vertical upper latch control piston bores 44 (FIGS. 2, 3 and 5) which are aligned with and of the same diameter as the piston bores 37 in the lower section 26, are formed within the housing 42 of section 27 and an upper latch control piston 45 is movable within each bore. A coiled spring 46 surrounding the upper portion of each piston urges the piston 45 downwardly and since the pistons 45 and 38** are of the same peripheral location and size, said pistons may contact each other in the manner shown in FIG. 2A.

The flange **26*b* has its lower surface inclined as shown at 26*c* and this inclined surface overlies the interior of the chamber within which the bearings 40 and 41 are mounted (FIG. 2A). Immediately below the flange 26*b* is a Belleville washer 47. This washer is normally supported at its inner end by a relatively thin wall sleeve 48 surrounding the upper portion of the section 26; the outer periphery of the washer 47 rests upon a thrust ring 49 which is secured to the inner wall of the housing 39. Under normal operation the bearings 40 and 41 carry the thrust or load imposed on housing 39. As will appear the main thrust will be in an upward direction so that the upper bearing assembly 40 is carrying the load. If the load becomes excessive, and exceeds the strength of the Belleville washer 47, the washer collapses to the position shown in FIG. 4 and the excess load is transferred from the bearing assembly 40 through the washer 47 and directly to the flange 26*b* of the lower section 26 of the main body. Since the lower section of the main body is bolted in position it is capable of carrying excessive loads. Thus, the interposing of the spring-type washer 47, having a predetermined strength, between the two sections of the body 26 results in the bearing assembly carrying that predetermined load for which it is designed but transferring such load through the washer directly to the immovable lower section 26** of the main body when such load is exceeded. Thus, a means coacting with the bearing assembly for transferring the excess above a predetermined pressure load directly to the annular body is provided.

The Kelly joint K (FIGS. 2, 3, 10 and 11) is illustrated as extending downwardly through the assembly in the usual manner. As is well known, the Kelly joint is multi-angular in cross section and is rotated by the usual rotary table 21 on the derrick floor. Said joint is also connected to the drill pipe which carries the drill bit at its lower end. In order to seal off around the Kelly joint or around a pipe which may be extending through the rotating blowout preventer 25, a sealing or stripper assembly is provided. This assembly is most clearly shown in FIGS. 2, 3 and 7 and includes a tubular body 50 which is connected by threaded pins 51 to the upper end of a flexible tubular sealing assembly 52. The tubular body 50 has an enlarged upper end forming an external annular shoulder 53 which overlies the upper end of a latch collar 54 and suitable bearing means 55 is interposed between the shoulder and the upper surface of the collar. The latch collar 54 has a latching groove 56 extending circumferentially around its exterior for coacting with a latching lug 38*a* mounted within a recess 38*b* in each piston 38 (FIG. 6). Each recess has an inclined vertical wall section 38*c* and a horizontally extending flat bottom 38*d*. Each latching lug 38*a* is formed to co-act with the recess 38*b* in a manner to project from the recess and outwardly of the bore of the lower section 26 of the main body when the lug is in the upper portion of its recess; when in a lower position with respect to the recess the latching lug is retracted inwardly. To prevent each latching lug from falling inwardly from its recess 38*b*, each lug is formed with retaining flanges 238 (FIG. 6A), which co-act with shoulders on the piston 38 to limit such inward movement.

Figure 3:
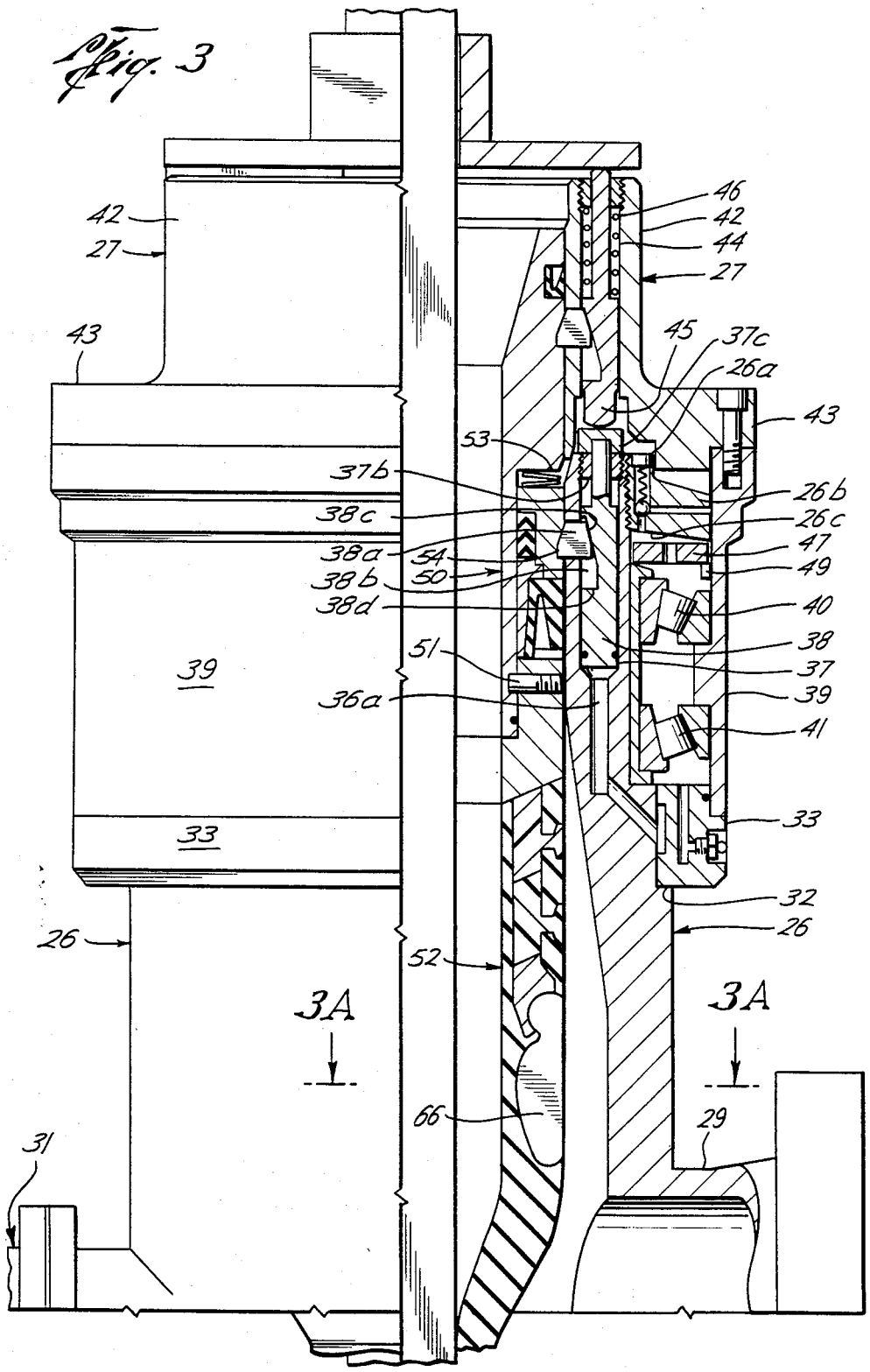
FIG. 3 is a somewhat enlarged view, partly in section and partly in elevation, of the upper portion of preventer.
Figure 7:
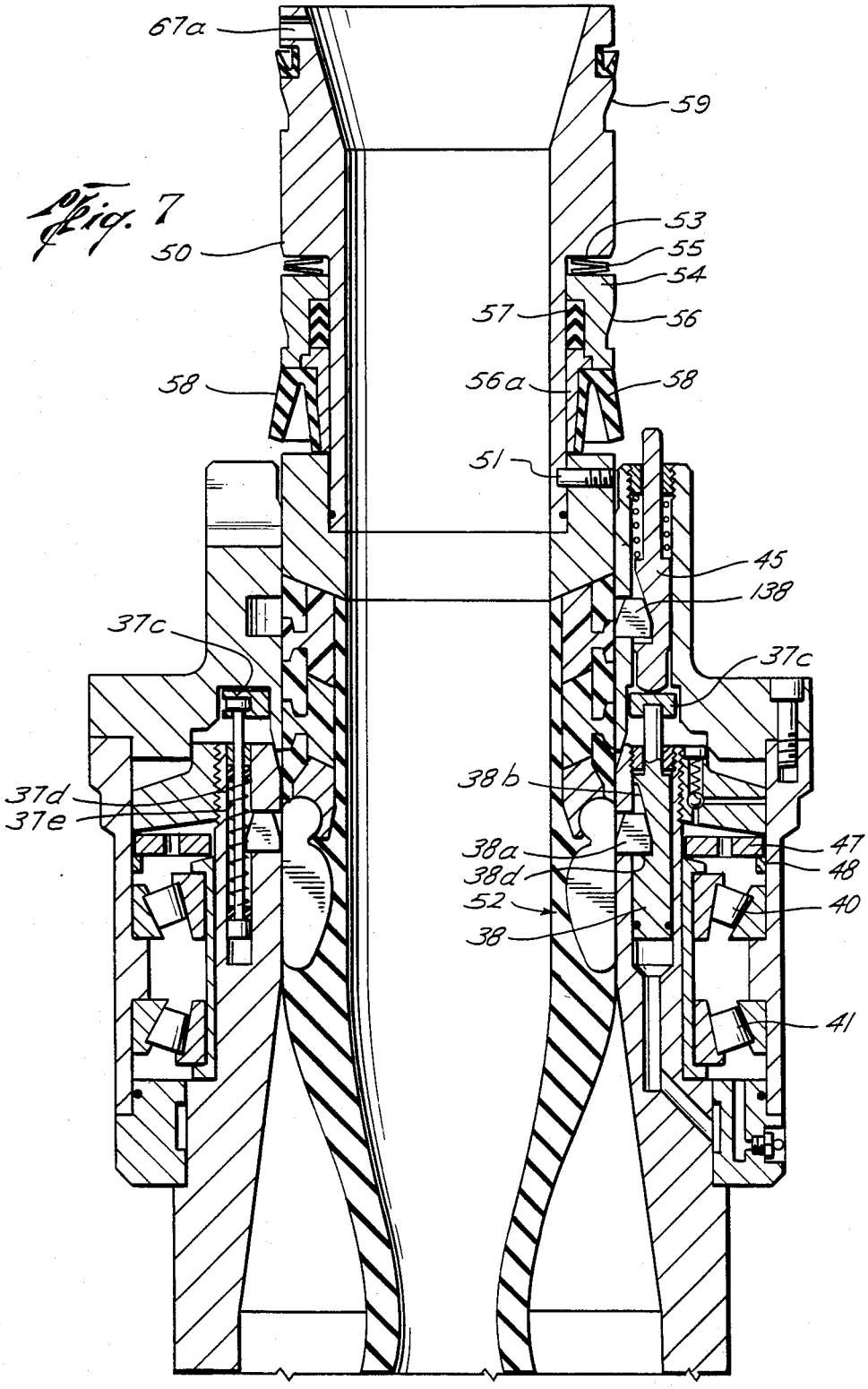
FIG. 7 is a vertical sectional view, illustrating the sealing assembly in unlatched position and being withdrawn from the outer body of the preventer.

As shown in FIGS. 2, 2A and 3, the latching lugs 38*a* engage the latching groove 56 of the latch collar 54 when said lugs are in the upper portion of the recesses 38*b*. In such position, the inner sealing assembly is latched against an upward movement with respect to the body sections 26 and 27. However, because the latch collar is formed with the circumferential groove 56 and the latching lugs 38*a* are confined within recesses, the inner sealing assembly may rotate relative to the lower non-rotatable section 26 of the outer body. When the lugs are in their lower position within their respective recesses as shown in FIG. 7, said lugs are retracted and the sealing assembly is unlatched from the lower body section 26.

The latch collar 54 has an internal annular recess which receives suitable packing rings 57 for sealing about the exterior of the tubular body 50 of the sealing assembly. A retaining sleeve 56*a* engages the lower end of the latch collar 54 and retains the packing rings in position. A packing element 58 surrounds the sleeve and provides a seal between the outer periphery of the sealing assembly and the bore of the body section 26 (FIG. 2A).

The upper portion of the body 50 of the sealing assembly has a plurality of recesses 59, each of which is located so that it may be disposed opposite a latching lug 138 mounted in the upper latch piston 45. The latching lug 138 is disposed within a latching recess 138*b* in the piston and functions in the same manner to latch and unlatch as does the lower latching lug 38*a*. Its inward movement is limited by side retaining flanges 238*a*, similar to the flanges 238 on the latching lug 38*a*. Because the upper latching lugs engage in recesses 59, the sealing assembly cannot rotate relative to the upper section. Therefore, when the parts are in the position of FIGS. 2 and 3, said upper latching lugs connect the flexible sealing element 52 to the upper rotatable section 27 of the outer body. Since the flexible element is connected with the body 50 by the pins 51, a rotation of said flexible element will impart rotation to the upper section 27 of the outer body of the blowout preventer and the bearing means 40 and 41 will support such rotative movement.

Figure 10:
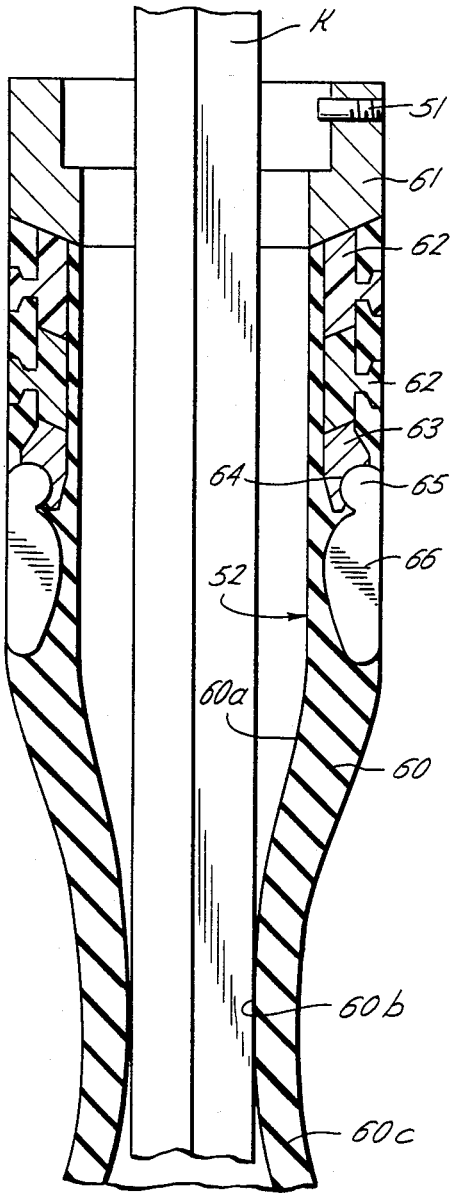
FIG. 10 is an enlarged vertical cross-sectional view of the sealing member in its relaxed position.
Figure 11:
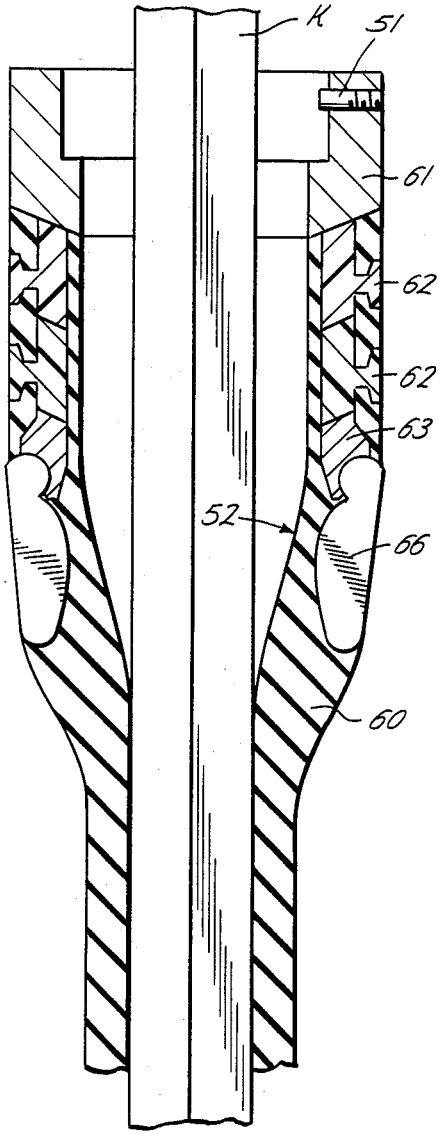
FIG. 11 is a view similar to FIG. 10 with the sealing member deformed onto its sealing position by the pressure from below.

The flexible sealing assembly 52 which engages and seals with the Kelly or other joint K which is attached to the tubular body 50 is most clearly shown in FIGS. 10 and 11. This element includes a relatively elongated sealing or stripper sleeve 60 which in its normal position has the particular shape illustrated in FIG. 10. The lower portion of the sleeve is inclined inwardly as shown at 60*a* with its engagement with the joint within the area designated 60*b*. Below its point of sealing with the joint the sleeve flares outwardly as shown at 60*c*. This position of the sleeve is normal and there is sufficient frictional contact between the joint K and the sleeve 60 to maintain a seal under normal pressure conditions during drilling or stripping operations.

The upper end of the sleeve 60 is suitably attached to a support collar 61 which is the member connected through pins 51 with the upper body 50 of the assembly. For reinforcing the upper end of the sleeve 60 against excessive circumferential expansion, a plurality of metallic rings 62 are molded within the material of the sleeve. Below the lowermost metallic ring 62 is a metal supporting collar 63. A plurality of sockets 64 are formed in the lower outer portion of the collar and each socket is adapted to receive the ball-like upper end 65 of a metallic reinforcing element 66. Each reinforcing element is relatively elongate in a vertical direction but is generally curved in horizontal cross section as shown in FIG. 3A. The elements are so disposed in relation to each other that as the flexible sleeve increases circumferentially under pressure, the reinforcing elements swing in a horizontal plane and because they remain in a somewhat overlapping postion they reinforce the element and limit its circumferential expansion. Since each reinforcing element is located within a ball-like socket, the elements 66 may move universally in all directions to follow the deformation of the flexible sleeve. It is believed that when excessive pressure is applied to the flexible sleeve 60 it will be deformed or moved into the approximate position shown in FIG. 11. In such figure, the reinforcing element 66 will swing inwardly toward the joint K and thereby continue as a supporting or reinforcing element for the sleeve. At the same time, the application of pressure to the exterior and lower portion of the sleeve will foreshorten the sleeve and tend to displace the upper end of the sleeve outwardly. At the same time, the universal mounting will permit the elements to swing in a horizontal plane and thereby assure proper support and reinforcing against excessive circumferntial movement. Any excessive outward or circumferential movement at the upper end of the flexible sleeve will be resisted by the annular rings 62 to thereby prevent undue distortion in the upper end portion of the sleeve.

The flexible sealing assembly will, under normal conditions, be in substantially the position shown in FIG. 2. In such position the lower portion of the elongate sealing sleeve 60 will have frictional contact with the Kelly joint K and will seal at that point. As the Kelly joint is rotated by the rotary table, the frictional contact between the flexible sleeve 60 and said joint will result in rotating the sealing assembly. Since the latching lugs 138 connect the sealing assembly with the upper section 27 of the outer body, the section 27 will also rotate. The pressure in the area surrounding the sleeve is acting upwardly against the flexible sleeve 60 and this upward thrust will be transmitted through the latching lugs to the upper section 27 whereby said section will tend to move upwardly. This upward thrust or pressure load upon the upper bearings 40 is applied against the Belleville washer 47 which has adequate strength to carry the normal load. However, if the pressure load exceeds the strength of the Belleville washer 47 of the main body, then the washer will move to the position of FIG. 4 and the excess load will be transferred from the bearing assemblies directly to the lower section 26 of the body.

Since the flexible sleeve 60 is relatively elongate, its lower portion may undergo movement in a radial or lateral manner without interfering with its sealing function. It is actually the length of the flexible sleeve locating the end of sleeve a substantial distance from its pivot point which permits its lower end to readily follow substantial lateral or radial movement of the joint.

Figure 8:
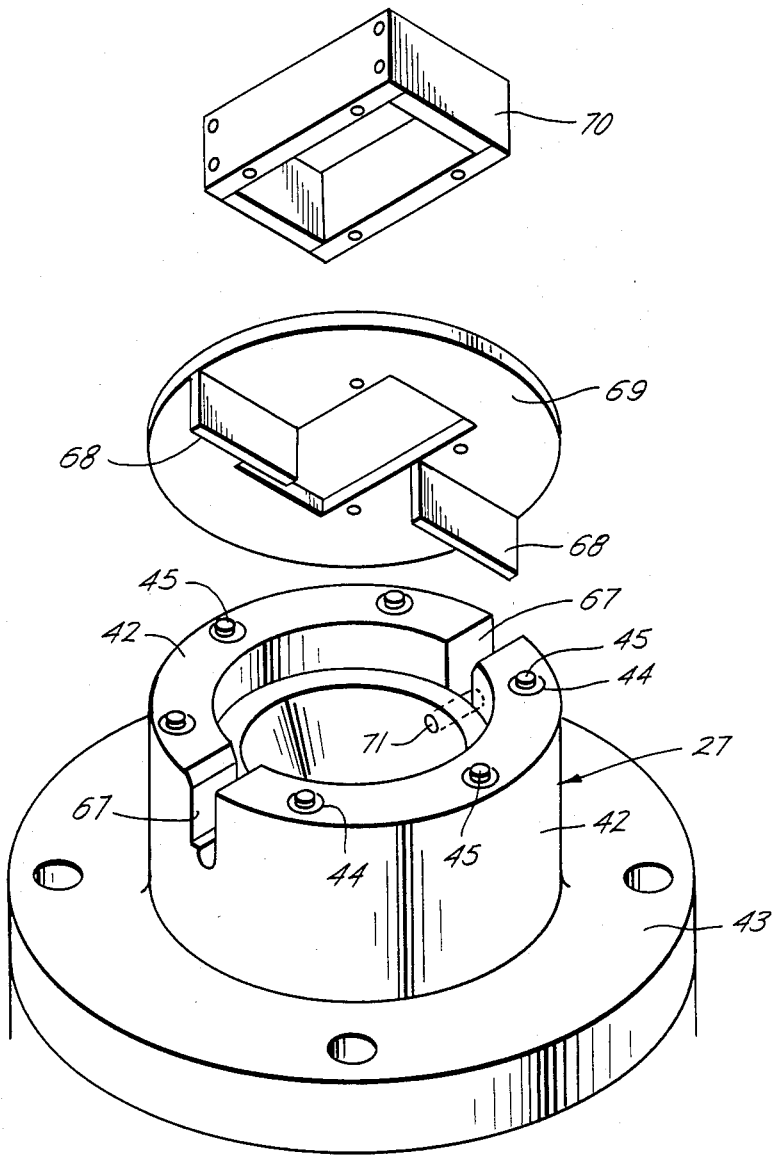
FIG. 8 is an exploded, isometric view of the elements through which the rotating pipe or joint extends and which permit radial or lateral movement of the Kelly joint relative to the body of the blowout preventer.

In order to permit the Kelly joint K to move laterally with respect to the upper end of the assembly, the uppermost housing 42 of section 27 of the outer body is provided with oppositely-located recesses 67. The recesses, clearly shown in FIGS. 2 and 8, are adapted to be engaged by downwardly extending plate members 68 which are secured to the underside of a circular disk 69. Attached to the top of the disk 69 is a box-like element 70 which is generally rectangular in shape. The longitudinal axis of member 70 is at a right angle to the slots 67 in housing 42 and the Kelly joint K extending through the box-like member 70 and an aligned rectangular opening in disk 69 may move along its longitudinal axis; at the same time, the disk 69 is able to move laterally as its depending plate members move in the recesses 67. Thus, the joint K drives upper section 27 through disk 69 and may undergo movement in any direction without placing any strain on the upper portion of the assembly. To prevent unintentional displacement of the members 68 and 70 the lower end of each slot 67 is formed with a recess 67*a*, and a pin 71 (FIGS. 2 and 8) extends through each recess 67 and within an opening 71*a* in the upper portion of the upper member 50 of the sealing assembly. When the sealing assembly is to be removed the pin 71 is sheared by engaging the upper end of each latching piston 45 located in the upper section 27 of the outer body with the underside of disk 68.

Unit 31 is a pressure responsive block valve arrangement. This block valve prevents the user from unlocking the packing element when it has significant pressure beneath it. Well pressure urges the piston outwardly so that the slide valve blocks the unlocking pressure.

The unit 31 includes an outer body 72 having a cylindrical bore 72*a* within which a multiple piston assembly 73 is movable. A pressure line 74 extending from a surface control 75 is connected to the body 71 between two of the pistons of unit 31 and is in communication with the line 76 which is connected to the pressure line 34 conducting pressure to the passages 36*a* below the lower latching pistons 38 within the outer body. The third piston of the assembly 73 is exposed to the well pressure within the body sections 26 and 27 below the sealing assembly and such pressure constantly urges the multiple piston of unit 31 in the direction to the left in FIG. 9; its movement is resisted by a spring 77 which requires that a predetermined pressure must act against the piston in order to shift the pistons to connect the line 74 with the vent passages 78 and establish communication with the conductor 34.

Figure 9:
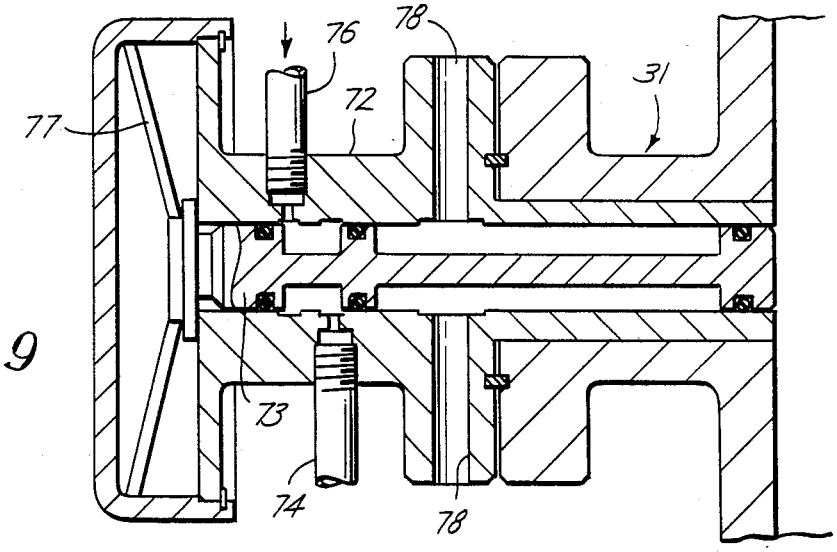
FIG. 9 is a horizontal cross-sectional view of the equalizing valve means which may communicate with the area below the sealing assembly to equalize the pressures across said assembly.

In operation, the unit parts are in the position shown in FIG. 9 with the spring 77 being of a predetermined strength. So long as the multiple piston 73 remains in the position of FIG. 9, the control 75 at the surface may direct the pressure from the line 74 through the lines 76 and 34 and then to the actuating pistons 38 within the assembly. However, whenever the pressure below the sealing assembly exceeds the strength of the spring 77, the multiple piston 73 is moved to the left in FIG. 9 and any pressure from the source through line 74 will be vented to atmosphere through the vents 78. Unit 31 provides a means responsive to well pressure for blocking the latching means release so as to prevent unlatching the sealing assembly while it contains well fluids under pressure within a well.

Figure 4:
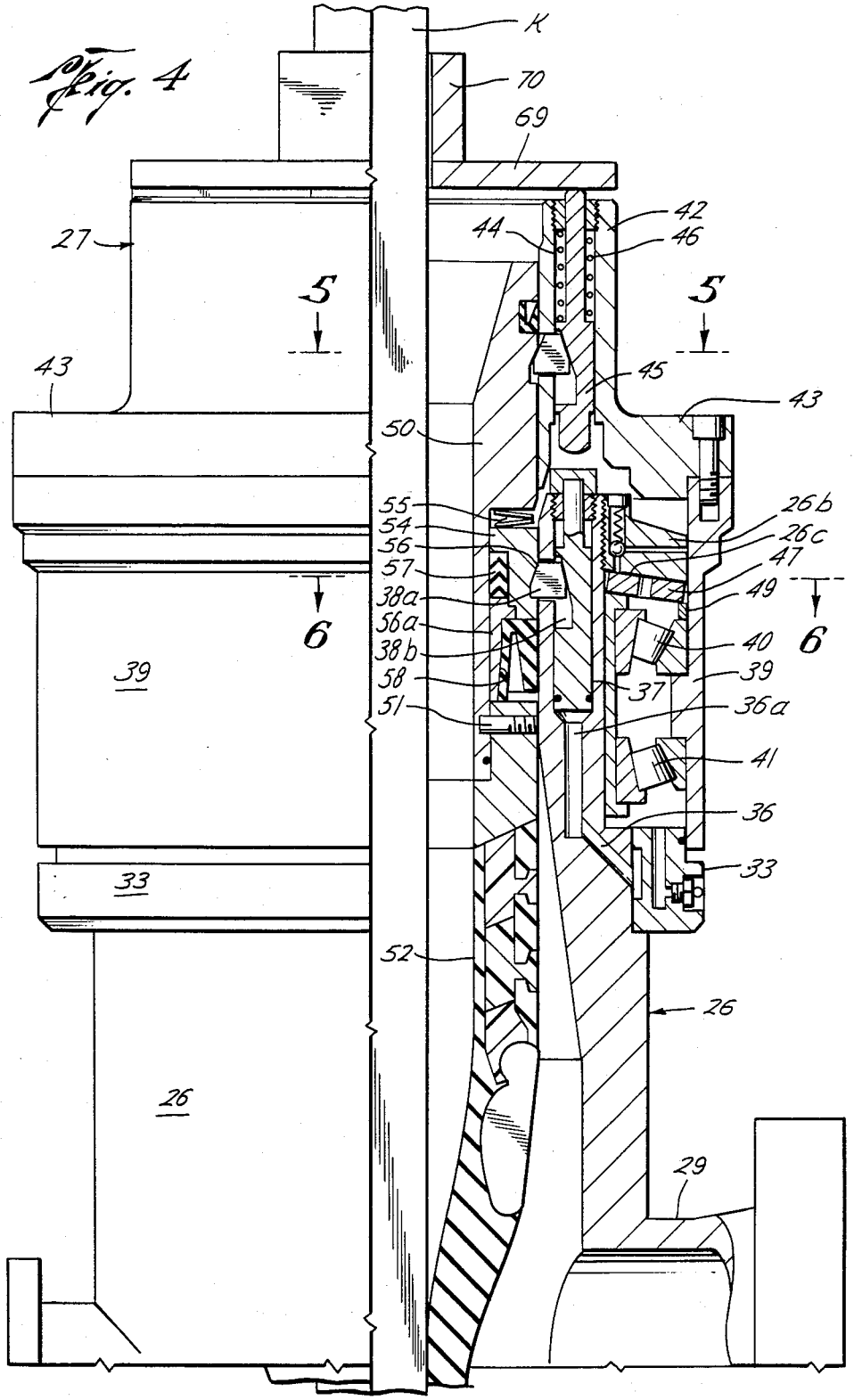
FIG. 4 is a view similar to FIG. 3 with the packing element under pressure and illustrating the Belleville washer in a collapsed position to transfer the load from the bearings to the main body of the unit.

Referring back to the latching pistons 38 which coact with the latching lugs 38*a* connecting the lower section 26 of the body to the sealing assembly and the pistons 45 having the latching lugs 138 connecting the upper section 27 of the outer body to the sealing assembly, it will be seen that when the parts are in the position of FIG. 2 the sealing assembly is in a latched position. When it is desired to remove the sealing assembly, the surface control 75 is actuated to direct hydraulic pressure through the line 34 and into the passages 36 and 36*a*, wherein it acts against the lower end of lower latching pistons 38. Upon the introduction of hydraulic pressure below the lower pistons 38, said pistons move upwardly to permit retraction of the latching lugs 38*a*. As the pistons move upwardly, the upper end of said pistons 38 strike the lower ends of the upper pistons 45, causing the latter to move upwardly and allow retraction of the latching lugs 138. Simultaneously, the upper ends of pistons 45 strike the disk 69, shearing the pin 71 and releasing the parts 69 and 70 so they may be removed. Thereafter, it is only necessary to move the sealing assembly upwardly as illustrated in FIG. 4 to remove it from the outer body by any suitable means. Normally, a drill collar is pulled upwardly and engages the lower end of the sealing element and effects removal of the assembly.

In operation, the assembly is connected as shown in FIG. 1 and the inner sealing assembly is latched into place within the outer body with all parts in substantially the position of FIG. 2. When the Kelly joint or pipe K is moved downwardly through the device, the lower portion of the flexible sealing element 60 frictionally engages the outer surface of the joint. As previously noted, the frictional contact between the sealing element and the joint is sufficient to maintain a fluid-tight or pressure-tight seal. Because of the elongate sealing element, its lower end may readily move laterally as the joint undergoes lateral or radial movement during drilling or other operations. The length of the flexible element 60 provides a relatively long distance between the lower end of the element and the point from which its upper end is attached and this permits a substantially amplified lateral movement without interfering with the sealing action. Also, the seal is maintained without excessive circumferential tension within the flexible material, particularly at the upper end of the element.

When the sealing element is subjected to excessive pressures and moves to substantially the position shown in FIG. 11, the major pressure load upon this element is transmitted upwardly and is carried either by the bearing assembly 40 or, if the Belleville washer has collapsed, the excess is carried by the outer main body 26 of the device. The sealing element 60 is deformed inwardly and upwardly into approximately the position shown in FIG. 11 by the pressure and if deformed sufficiently, the reinforcing elements 66 swing inwardly to substantially form a reinforcing cone-like support which extends circumferentially within the material of the sealing element. Thus, under higher pressure conditions, the reinforcing elements 66 and the annular rings 62 provide the proper support of the sealing section as it engages the Kelly joint or pipe about which it is located. It is also noted that at the same time the annular support rings 62 prevent an excessive deformation of the upper portion of the sealing element and eliminate any excessive circumferential strain on the flexible material.

As previously described, the pressure load which is directed against the sealing element 60 is transmitted upwardly and through the upper latching lugs 138 to the upper section 27 of the outer body. So long as this pressure load does not exceed the strength of the Belleville washer 47, the upper bearing assembly 40 carries the load; however, any excess pressure load causes the collapse of the Belleville washer from the position of FIG. 3 to that in FIG. 4, and thereafter, the excess load is transferred to the outer body 26 which is, of course, well able to handle any pressure load. It might also be noted that the lower latching lugs 38*a* are directly engaged by the sealing assembly and since the lugs are carried by the immovable lower stationary section 26 of the outer body, a part of the load is carried by said section 26 to reduce the load which is transmitted upwardly by the upper latching lugs 138, through the section 27 and then to the bearing assembly 40. This results in less wear and longer life of the bearings.

At any time that it is desired to reove the sealing assembly, it is only necessary to actuate the latches through the hydraulic control 75 which will disconnect the sealing assembly from the outer body. The sealing assembly then can be removed by any suitable means including engagement by one of the drill collars or other enlargement on the pipe being removed.

The present invention solves one of the major problems of constructing an effective rotating blowout preventer by making possible a minimum diameter sealing assembly. Unless the sealing element is of a relative small diameter, the horsepower required and the heat generated become prohibitive from a practical standpoint. The present sealing element can be of minimum diameter because the bearings which carry the load are not a part of the removable assembly; instead, the bearings are located in the body which is permanently mounted below the rotary table. Since the bearings are not located in the removable assembly, they may be larger and mounted in a position relative to the load point on the sealing assembly to assure proper support while at the same time providing a longer bearing life.

Another feature of the bearing assembly is its mounting in combination with the load spring, here illustrated as a Belleville washer, which subjects the assembly to only a predetermined load. As explained if such load is exceeded, the excess load is transferred directly to the permanently mounted body of the unit to relieve the bearings of excessive wear. Although the Belleville washer had been found satisfactory for the purpose, it is apparent that other load-carrying spring means may be employed.

What is claimed is:

1. A rotating blowout preventer including, an annular body adapted to be connected to the upper end of a well casing, a rotatable element extending through the body, an annular support housing within the body, a sealing assembly carried by the housing for sealing the annular space between the body and said rotatable element, a bearing assembly capable of supporting a predetermined normal pressure load and located between said housing and its sealing assembly and the body for rotatably mounting the housing and sealing assembly within the body, whereby the sealing assembly may rotate with the element with which it is sealingly engaged, means for applying to said bearing assembly the pressure load acting upon the sealing assembly when in its sealing position, and means coacting with the bearing assembly for transferring the excess pressure load from the bearing assembly directly to the annular body of the blowout preventer when said pressure load exceeds the predetermined normal pressure load.

2. A rotating blowout preventer as set forth in claim 1, wherein, the means coacting with the bearing assembly for transferring the excess pressure load to the main body is a spring means of predetermined strength.

3. A rotating blowout preventer as set forth in claim 1, wherein, the means coacting with the bearing assembly for transferring the excess pressure load to the main body is a Belleville washer of predetermined strength.

4. A rotating blowout preventer as set forth in claim 1, together with, latching means between the housing and its sealing assembly and the body for removably latching said assembly within the body.

5. A rotating blowout preventer as set forth in claim 1, together with, latching means between the housing and its sealing assembly and the body for removably latching said assembly within the body, and means for remotely controlling the latching means, whereby the sealing assembly may be unlatched without requiring a manual operation.

6. A rotating blowout preventer as set forth in claim 1, together with, latching means between the housing and its sealing assembly and the body for removably latching said assembly within the body, means for remotely controlling the latching means, whereby the sealing assembly may be unlatched without requiring a manual operation, and means responsive to well pressure for blocking the latching means release so as to prevent unlatching the sealing assembly while it contains well fluids under pressure within a well.

7. A rotating blowout preventer as set forth in claim 1, wherein, the annular body which is connected to the well casing is constructed of two sections which have limited axial movement relative to each other, and means for latching the upper section of said body to the support housing and sealing assembly, whereby said upper section may undergo the required axial movement to effect a transfer of the load from the bearing assembly to the immovable position of the blowout preventer body.

8. A rotating blowout preventer as set forth in claim 1, wherein, the annular body which is connected to the well casing is constructed of two sections which have limited movement relative to each other, means for latching the upper section of said body to the support housing and sealing assembly, whereby said upper section may undergo the required movement to effect a transfer of the load from the bearing assembly to the immovable position of the blowout preventer body, and means for remotely controlling the latching means from a location remote from the blowout preventer.

9. A rotating blowout preventer as set forth in claim 1, wherein, the annular body which is connected to the well casing is constructed of an upper and lower section with the upper section being capable of limited movement relative to the immovable lower section, means for latching the upper section of said body to the support housing and sealing assembly, whereby said upper section may undergo the required movement to effect a transfer of the load from the bearing assembly to the immovable section of the blowout preventer body, means for controlling the latching means from a location remote from the blowout preventer, and means responsive to well pressure from blocking the latching means release so as to prevent unlatching the sealing assembly while it contains well fluids under pressure within a well.

10. A rotating blowout preventer as set forth in claim 1, wherein, the annular body which is connected to the well casing is constructed of two sections, the upper of which has limited movement relative to the lower section, means for latching the upper section of said body to the support housing and sealing assembly, whereby said upper section may undergo the required movement to effect a transfer of the load from the bearing assembly to the immovable lower section of the blowout preventer body, means for latching the lower immovable section of said preventer to the sealing assembly whereby a double latch connection is provided, and means for controlling the latches from a location remote from the blowout preventer.

11. A rotating blowout preventer including

I. an annular body adapted to be connected to the upper end of a well casing and having a vertical bore at least as large as the well casing and including (A) a rotating portion mounted on a (B) non-rotating portion II. thrust bearing means (A) carried by the body portions (B) for controlling their axial relationship III. first locking means (A) carried by the rotating body portion and (B) extendable into the body bore, IV. second locking means (A) carried by the non-rotating body portion and (B) extendable into the body bore, V. an annular packing assembly having an outer diameter adapted to fit within the body bore and including (A) a non-rotating portion, (B) a rotating portion carried above the non-rotating portion and extending through it, (C) lost motion means connecting the portions for limited relative axial movement and unlimited relative rotation, (D) means for sealing between the portions subtending a pressure responsive area smaller than that of the head bore, (E) first cooperating means (1) carried by the rotating portion and (2) adapted to engage the first locking means so as to transmit pressure loadings to the body portion, (F) second cooperating means, (2) carried by the non-rotating portion and (2) adapted to engage the second locking means so as to transmit pressure loadings to the non-rotating body portion.

12. A rotating blowout preventer as in claim 11 but including, in addition, stop means on the body and on the packing assembly cooperable to limit the relative telescoping movement and to position respective locking and cooperating means.

13. A rotating blowout preventer body having a bore, a rotating element extending through the bore, a sealing assembly adapted to seal the annular space between the rotating element and the wall of the bore, means for rotatably mounting the sealing assembly within the bore of the body to engage and seal about the exterior of the rotating element during rotation of said rotating element, the sealing assembly including a flexible tubular sealing member which when in its relaxed position is elongate and tubular with the major portion of its bore spaced from the exterior of the rotating element and only its lower end portion tapered inwardly to engage said rotating element, the exterior of said sealing member having the major portion of its exterior spaced from the wall of the bore of the preventer body and being exposed to the pressure therebelow, said pressure functioning to displace the member upwardly and inwardly to cause a substantial portion to engage the rotating element and thereby effect a positive seal between the major portion of its bore and the exterior of the rotating element under high pressure conditions, a plurality of rigid reinforcing elements within the upper portion of the flexible sealing member, means for mounting said reinforcing elements to swing inwardly as the sealing member is moved into full sealing position with the rotating element extending through the blowout preventer bore, such inward movement of the elements assuring proper support of said sealing member, a plurality of reinforcing rings within the upper portion of the flexible material of the sealing assembly above the rigid reinforcing elements, and inclined coacting surfaces on adjacent reinforcing rings to permit limited outward radial movement of the rings to prevent excessive circumferential displacement of the upper end of said sealing member.

14. A rotating blowout preventer body having a bore, a rotating element extending through the bore, a sealing assembly adapted to seal the annular space between the rotating element and the wall of the bore, means for rotatably mounting the sealing assembly within the bore of the body to engage and seal about the exterior of the rotating element during rotation of said rotating element, the sealing assembly including a flexible tubular sealing member which when in its relaxed position is elongate and tubular with the major portion of its bore spaced from the exterior of the rotating element and only its lower end portion tapered inwardly to engage said rotating element, the exterior of said sealing member having the major portion of its exterior spaced from the wall of the bore of the preventer body and being exposed to the pressure therebelow, said pressure functioning to displace the member upwardly and inwardly to cause a substantial portion to engage the rotating element and thereby effect a positive seal between the major portion of its bore and the exterior of the rotating element under higher pressure conditions, a plurality of rigid reinforcing elements molded within the upper portion of the flexible sealing member, means for mounting said reinforcing elements to swing inwardly as the sealing member is moved into a tight sealing position under high pressure conditions, such inward movement of the elements assuring proper support of said sealing member, a plurality of reinforcing rings embedded within the upper portion of the flexible material of the sealing assembly above the rigid reinforcing elements, and inclined coacting surfaces on adjacent reinforcing rings to permit limited outward radial movement of the rings to prevent excessive circumferential displacement of flexible material at the upper end of said sealing member.

15. As a sub-combination in a rotating blowout preventer having a rotating member extending therethrough, a sealing assembly comprising an elongate flexible tubular sealing element which is adapted to surround the rotating member, said flexible sealing element being of such configuration in vertical cross section that when in its relaxed position the major portion of the wall of its bore is spaced from the exterior of the rotating member, the wall of said bore of said sealing element being inclined at a relatively small angle inwardly and downwardly toward its lower portion and terminating at a point spaced from the lower end of the element, the portion of the wall of the bore below said inclined bore wall being directed outwardly to terminate in a relatively short flared area, a plurality of rigid reinforcing elements molded within the upper portion of the flexible sealing member, means for mounting said reinforcing elements to swing inwardly as the sealing member is moved into a tight sealing position under high pressure conditions, such inward movement of the elements assuring proper support of said sealing member, a plurality of reinforcing rings embedded within the upper portion of the flexible material of the sealing assembly above the rigid reinforcing elements, and inclined coacting surfaces on adjacent reinforcing rings to permit limited outward radial movement of the rings to prevent excessive circumferential displacement of flexible material at the upper end of said sealing member.

16. A rotating blowout preventer including, an annular body adapted to be connected to the upper end of a well casing, a rotatable element extending through the body, an annular support housing within the body, a sealing assembly carried by the housing for sealing the annular space between the body and said rotatable element, a bearing assembly capable of supporting a predetermined pressure load and located between said housing and its sealing assembly and the body for rotatably mounting the housing and sealing assembly within the body, whereby the sealing assembly may rotate with the element with which it is sealingly engaged, latching means between the housing and its sealing assembly and the body for removably latching said assembly within the body, means for remotely controlling the latching means, whereby the sealing assembly may be unlatched without requiring a manual operation, and means responsive to well pressure for blocking the unlatching of the latching means so as to prevent unlatching the sealing assembly while it contains well fluids under pressure within a well.

17. A rotating blowout preventer as set forth in claim 16 wherein said latching means comprises a plurality of latch members positioned between the housing and sealing assembly and movable between latched and unlatched positions, and, a plurality of fluid operated pistons cooperating with said latch members to move said latch members to unlatched position when the pistons are actuated, said means for remotely controlling the latching means comprising remotely controlled fluid pressure means for actuating said pistons.

18. A rotating blowout preventer comprising, an annular body having a bore and adapted to be connected to the upper end of a well casing, said body having an upper body section and a lower body section, the upper body section having a housing extending downwardly therefrom and encircling the upper portion of said lower body section, a removable annular sealing assembly carried by said housing and positioned within said bore in concentric relation to the housing to receive in sealing relation a Kelly joint extending downwardly through the body section and sealing assembly, and a bearing assembly positioned between said housing and said lower body section for rotatably mounting the housing and associated sealing assembly within said body, said upper body section having on its upper end an elongate slot receiving said joint and permitting lateral movement of said joint relative to said bearing assembly and said annular body, said sealing assembly adapted to seal the annular space between the joint and the bore, and having a flexible tubular sealing member engaging said Kelly joint in sealing relation for a substantial longitudinal portion thereof.

19. A rotating blowout preventer as set forth in claim 18, wherein a plate-like member is mounted on the upper end of said upper body section for rotation with said upper body section, said plate-like member having an elongate slot receiving said joint to permit relative lateral movement therebetween.

20. A rotating blowout preventer as set forth in claim 19, wherein means mount said plate-like member for limited rotational and vertical movements relative to said upper body section.

21. A rotating blowout preventer as set forth in claim 18, wherein said removable sealing assembly includes a generally cylindrical upper end portion having a plurality of rigid reinforcing rings therein, a flexible elongate lower end portion extending downwardly and inwardly from said upper end portion to form a flexible sealing sleeve about said Kelly joint for a substantial longitudinal portion of said joint, and hinge means between said upper end portion and said lower end portion to permit said flexible lower end portion to move freely with said Kelly joint in lateral and radial movements thereof.

22. A rotating blowout preventer as set forth in claim 21, wherein said removable sealing assembly has rigid reinforcing rings imbedded in said upper end portion, and said hinge means includes a collar in said upper end portion positioned below said reinforcing rings, and a plurality of radially spaced hinge members secured at their upper ends to said collar and at their lower end to said flexible lower end portion.

23. A rotating blowout preventer comprising, an annular body having a bore and adapted to be connected to the upper end of a well casing, said body having a rotating body section and a non-rotating body section, a removable annular sealing assembly carried by said rotating body section and positioned within said bore in concentric relation to said rotating section for sealing about an elongate rotatable element extending downwardly through the body sections and sealing assembly, a bearing assembly positioned between said body sections mounting said rotating body section and associated sealing assembly within said body for rotation relative to said non-rotating body section, said removable sealing assembly having a substantially rigid upper end portion of a generally cylindrical shape and an elongate flexible lower end portion extending downwardly and inwardly from said upper end portion to form a sealing sleeve about said rotatable element for a substantial longitudinal portion thereof, and hinge means between said upper end portion and said lower end portion to permit said lower end portion to move freely with said rotatable element in lateral movements thereof.

24. A rotating blowout preventer as set forth in claim 23 wherein said removable sealing assembly has rigid reinforcing rings imbedded in said upper end portion, and said hinge means includes a collar in said upper end portion positioned below said reinforcing rings, and a plurality of radially spaced hinge members secured at their upper ends to said collar and at their lower ends to said flexible lower end portion.

25. A rotating blowout preventer comprising:

an annular body adapted to be connected to the upper end of a well casing and having a vertical bore at least as large as the well casing, said body having a rotating body section and a non-rotating body section, bearing means between said rotating section and non-rotating means to permit relative rotation of said rotating section;

an elongate rotatable element extending through said annular body, means connecting said rotatable element to said rotating section for rotation therewith;

a removable sealing assembly mounted within the bore of said annular body for sealing between said sections and said rotatable element;

latching means between said sealing assembly and said rotating body section for removably latching said sealing assembly to said rotating section for rotation therewith;

and means for remotely controlling said latching means whereof the sealing assembly may be unlatched without requiring manual operation.

26. A rotating blowout preventer as set forth in claim 25 wherein said latching means comprises a plurality of fluid operated latch members movable between latched and unlatched positions; and a plurality of remotely controlled fluid operated pistons cooperating with said latch members for moving said latch members to unlatched position.

27. A rotating blowout preventer as set forth in claim 25 wherein said means connecting said rotatable element to said rotating body section comprises a plate-like member loosely mounted on the upper end of said rotating body section, said plate-like member being mounted for limited horizontal and vertical movements relative to said rotating body section.

28. A rotating blowout preventer as set forth in claim 26 wherein said rotating body section is an upper body section and said non-rotating body section is a lower body section, and additional latch members are provided between said sealing assembly and said lower body section for removably latching said sealing assembly to said lower body section.

29. A rotating blowout preventer as set forth in claim 28 wherein means operatively connect said latch members for said upper body sections to said latch members for said lower body section for simultaneous movement to unlatched position.

30. A rotating blowout preventer comprising, a blowout preventer body having a bore through which an elongate rotating element extends, a removable annular sealing assembly mounted within the body and positioned within said bore in concentric rotation to said rotating element for sealing about said rotating element, said removable sealing assembly having a substantially rigid upper end portion of a generally cylindrical shape and an elongate flexible lower end portion extending downwardly and inwardly from said upper end portion to form a sealing sleeve about said rotatable element for a substantial longitudinal portion thereof, said upper end portion having a plurality of rigid reinforcing rings therein, and hinge means between said upper end portion and said lower end portion to permit said lower end portion to move freely with said rotating element in lateral movements thereof.

31. A rotating blowout preventer as set forth in claim 30, together with, means for latching the sealing assembly within the preventer body, and means for actuating said latching means from a location remote from the blowout preventer.

32. A rotating blowout preventer as set forth in claim 30, together with, means for latching the sealing assembly within the preventer body, means for actuating said latching means from a location remote from the blowout preventer, and means responsive to well pressure for blocking the latching means release so as to prevent unlatching the sealing assembly while it contains well fluids under pressure within a well.

* * * * *